US006452561B1

(12) United States Patent
West et al.

(10) Patent No.: US 6,452,561 B1
(45) Date of Patent: Sep. 17, 2002

(54) HIGH-ISOLATION BROADBAND POLARIZATION DIVERSE CIRCULAR WAVEGUIDE FEED

(75) Inventors: James B. West; Larry J. Gatewood, both of Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/820,268

(22) Filed: Mar. 28, 2001

(51) Int. Cl.[7] ..... H01Q 13/00
(52) U.S. Cl. ..... 343/772; 343/786; 343/783
(58) Field of Search ..... 343/772, 786, 343/783, 776, 778; H01Q 13/00

(56) References Cited

U.S. PATENT DOCUMENTS 3,287,729 A * 11/1966 Mark et al. ..... 343/756
4,041,499 A * 8/1977 Liu et al. ..... 343/756
4,241,353 A * 12/1980 Salvat et al. ..... 343/786
4,412,222 A * 10/1983 Mohing ..... 343/779
4,792,814 A * 12/1988 Ebisui ..... 343/786

* cited by examiner

*Primary Examiner*—Hoanganh Le
(74) *Attorney, Agent, or Firm*—Nathan O. Jensen; Kyle Eppele

(57) ABSTRACT

A high-isolation broadband polarization diverse circular waveguide feed apparatus capable of supporting any arbitrary linear, right-hand circular, left-hand circular or elliptically polarized electromagnetic wave with desirable performance over a broad range of frequencies and small size is disclosed. The waveguide feed employs the combination of a symmetrical shaped conical frustrum waveguide and circular waveguide segments together with a novel arrangement of orthogonal and nonplanar electric field probes and radio frequency impedance posts to achieve broad bandwidth, low cross-polarization when operating in arbitrary linear mode, and high-isolation for rejection of undesired cross-polarization components when operating in circular or elliptical polarization mode. Details of a 10.95–12.7 gigahertz embodiment of the waveguide feed including dimensions are provided. This apparatus is an elegant, simple, compact, and cost effective design that is applicable to a broad family of microwave antennas, but in particular those required to meet minimal radome swept volume requirements.

20 Claims, 7 Drawing Sheets

HIGH-ISOLATION BROADBAND POLARIZATION DIVERSE CIRCULAR WAVEGUIDE FEED

BACKGROUND OF THE INVENTION

The present invention relates to microwave radio frequency waveguide feed systems, and more particularly to a high-isolation, broadband, and polarization diverse circular waveguide feed for reception of Direct Broadcast Satellite (DBS) television and Internet satellite downlink services that operate worldwide.

The widespread demand for high-quality video, audio, and data communications via satellite has resulted in the need for additional bandwidth and better cross polarization rejection as well as reduced interference from noise or adjacent frequency operation. As a result, satellite broadcast systems are operating over broader and higher frequency ranges and implementing sophisticated methods to reduce interference and improve the intelligibility of communication signals that limit their operating capability. However, the radio frequency apparatus that operate at higher frequencies and with broader bandwidth require considerable design attention and often result in multiple and complicated waveguide feeds in order to account for electric and magnetic field behavior that exists inside the microwave waveguides that propagate their signals.

Also, in order to maintain reliable communication, transmit and receive systems must possess polarization compatibility, which is that property of a radiated wave of an antenna that describes the shape and orientation of the electric field vector as a function of time. Polarization compatibility further complicates the waveguide feed design because electromagnetic energy may be transmitted in arbitrary linear, right-hand circular, left-hand circular, or elliptical polarization.

It is well known in the art that square waveguides produce mode patterns that allow high efficiency injection or removal of energy for linear polarized electromagnetic waves using probe coupling, which results in orthogonal linear polarizations of high-isolation needed to reduce noise and unwanted adjacent frequency interference. Satellite systems, however, typically operate with circular polarization, which propagates well in circular waveguides, but generates undesirable cross polarization components and poor isolation when using orthogonal probe coupling methods in planar orientation. To minimize cross polarization components that result in a circular waveguide from the two orthogonal polarizations that comprise the circular polarized wave, elaborate conversion methods are employed to transform circular polarized electromagnetic waves. Polarity converters and filters are methods used to condition the circular polarized wave, but have the disadvantage of being difficult to design and possessing high cost and large size.

The present invention is a microwave feed assembly of simple, elegant, and scalable design that incorporates the desirable characteristics of broadband operation, polarization diversity, high-isolation between the orthogonal linear polarizations, low insertion losses, small size, and applicability to a broad family of antennas.

SUMMARY OF INVENTION

The present invention relates to a high-isolation, broadband, and polarization diverse circular waveguide feed for microwave frequency antennas. In one aspect of the invention, the waveguide feed supports transmission or reception of any arbitrary linear, right-hand circular, left-hand circular, or elliptical polarized microwave signal while achieving desirable performance over a wide range of frequencies with small size. In another aspect of the invention, the waveguide feed incorporates high cross-polarization rejection of unwanted $TE_{11}$ Mode components when operating in arbitrary linear mode. In yet another aspect of the invention, the waveguide feed employs high probe-to-probe isolation for rejection of undesired cross-polarization when operating in circular or elliptical polarization mode. A waveguide feed assembly is disclosed, which comprises a combination of symmetrical shaped conical frustrum waveguide and circular waveguide segments together with a novel arrangement of orthogonal and nonplanar electric field probes and radio frequency impedance posts to achieve high-isolation, broad bandwidth, and polarization diversity.

It is an object of the present invention to provide a microwave waveguide feed system that can transmit or receive arbitrary linear, right-hand circular, left-hand circular, or elliptically polarized electromagnetic waves.

It is another object of the present invention to provide a microwave waveguide feed system that will support operation over a broad range of frequencies.

It is yet another object of the present invention to provide a microwave waveguide feed system with cross polarization rejection greater than 20 dB.

It is yet another object of the present invention to provide a microwave waveguide feed system with probe-to-probe isolation greater than 30 dB when rejecting undesired linear cross polarization of the two orthogonal linear polarizations that comprise circular or elliptical polarized electromagnetic waves.

It is a feature of the present invention to provide a waveguide assembly that is polarization diverse for operation with arbitrary linear, right-hand circular, left-hand circular, or elliptically polarized electromagnetic waves.

It is yet another feature of the present invention to provide a compact, reliable, and simple to manufacture waveguide assembly that uses common materials and is suitable for reflector type antennas used to meet minimal radome swept volume applications by reducing the axial length of the waveguide assembly.

It is an advantage of the present invention to provide a waveguide assembly that is low cost, rugged, and applicable to a broad family of microwave antennas.

It is another advantage of the present invention to provide a microwave waveguide feed that can operate as a stand-alone microwave antenna system.

It is yet another advantage of the present invention to provide a waveguide assembly that incorporates design characteristics that are scalable to any frequency of microwave operation.

These and other objects, features, and advantages are disclosed in the specification, figures, and claims of the present invention.

DETAILED DESCRIPTION

Figure 1:
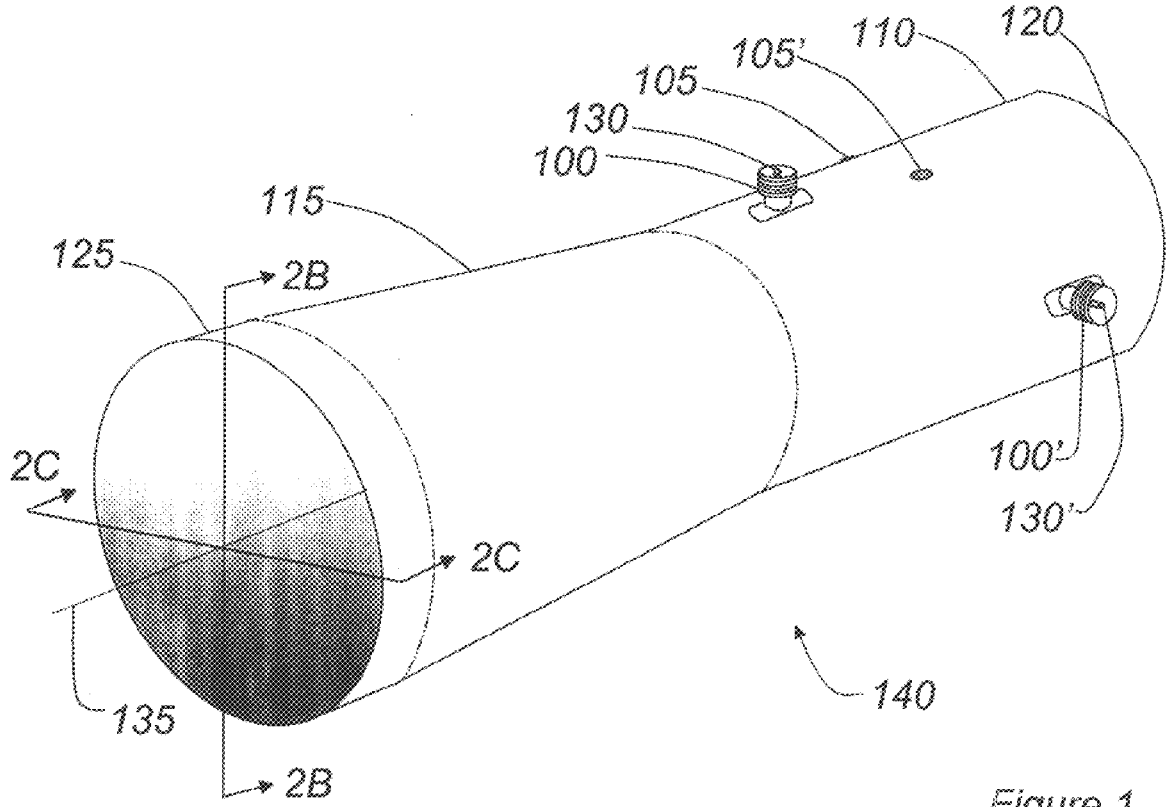
FIG. 1 is a perspective view of the high-isolation broadband polarization diverse circular waveguide feed constructed in accordance with the preferred embodiments of the present.
Figure 2A:
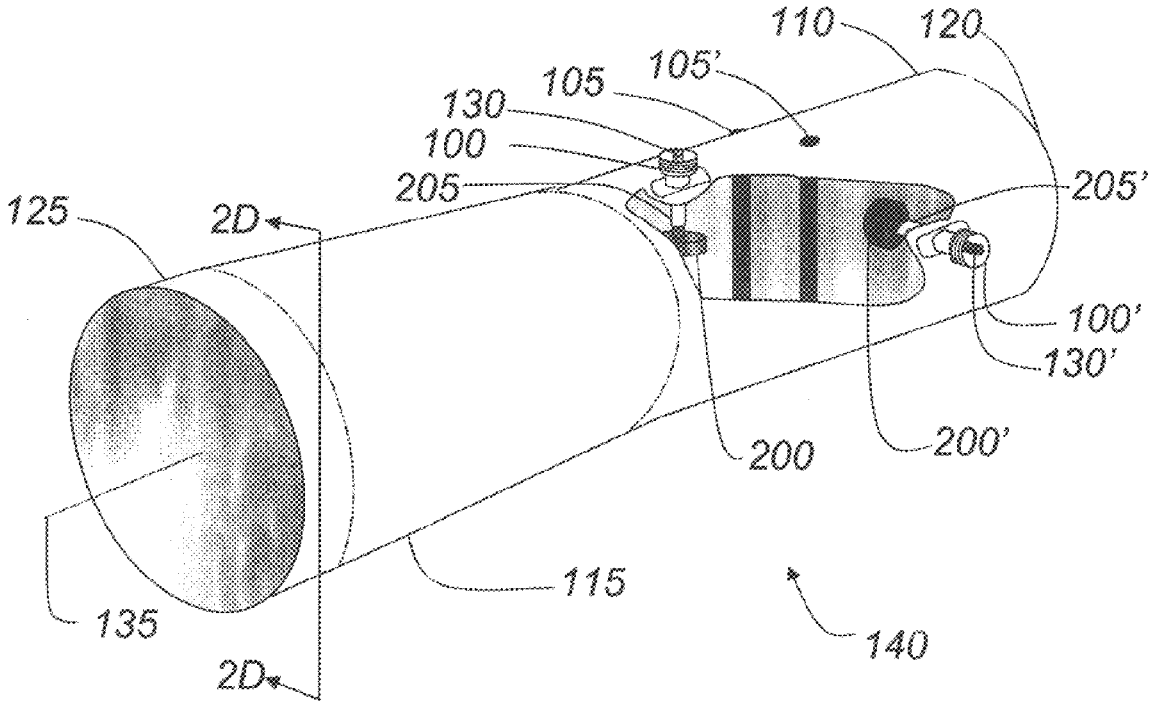
FIG. 2A is cutaway view of the high-isolation broadband polarization diverse circular waveguide feed in FIG. 1 having an exemplary view of component orientation and layout.
Figure 2B:
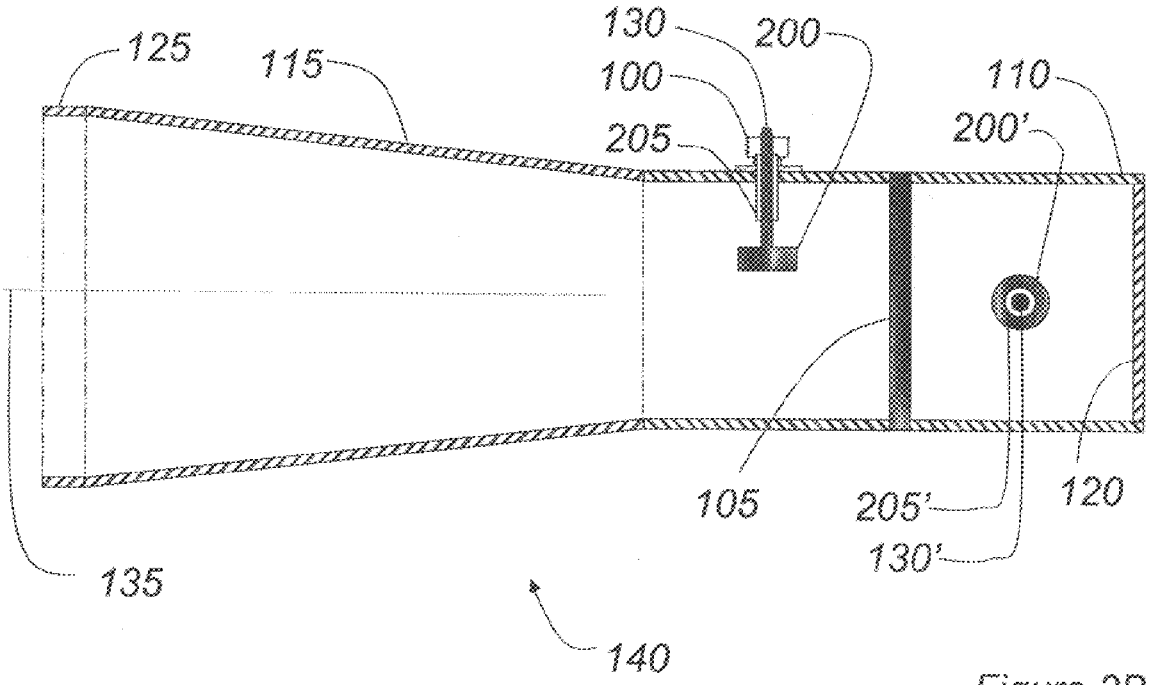
FIG. 2B is a side cross-section view of the high-isolation broadband polarization diverse circular waveguide feed in FIG. 1 having an exemplary view of component orientation and layout.
Figure 2C:
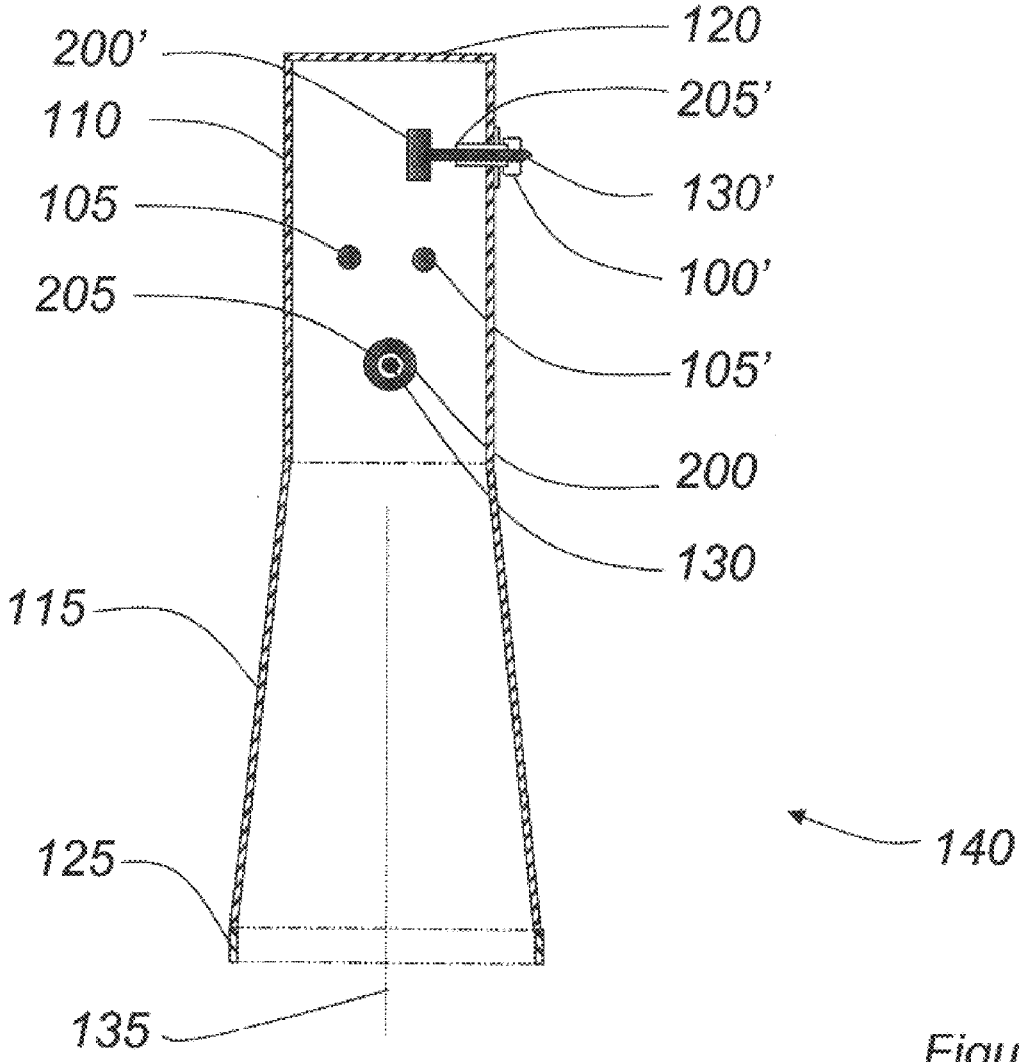
FIG. 2C is a top cross-section view of the high-isolation broadband polarization diverse circular waveguide feed in FIG. 1 having a exemplary view of component orientation and layout.
Figure 2D:
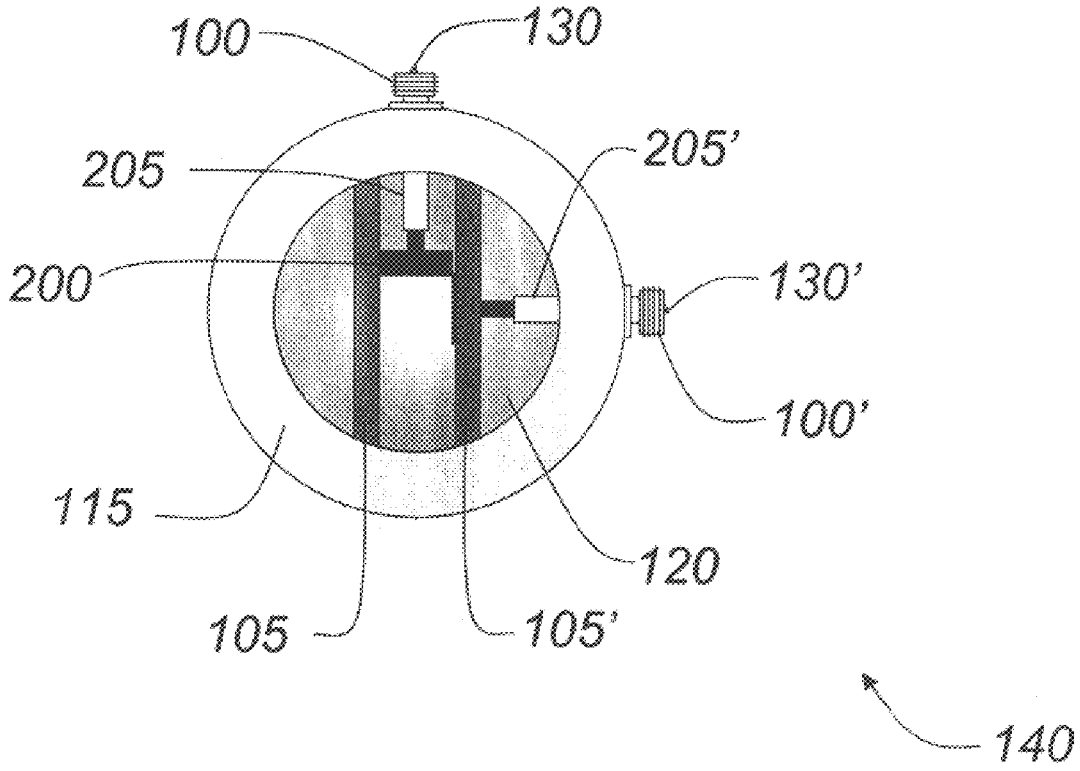
FIG. 2D is a front view of the high-isolation broadband polarization diverse circular waveguide feed in FIG. 1 having an exemplary view of component orientation and layout.

Referring now to the drawings wherein like numerals refer to like matter throughout, FIG. 1 shows a perspective view of the high-isolation broadband polarization diverse waveguide feed assembly 140 that incorporates the teachings of the present invention. The embodiment of FIG. 1 will be described with reference to operating ranges from 10.95 GHZ to 12.7 GHZ, X and Ku band, and for communication signals that are transmitted or received in arbitrary linear, right-hand circular, left-hand circular, or elliptical polarization. It is to be understood, however, that the invention is suitable for any broad frequency range and arbitrarily polarized electromagnetic wave transmit or receive system for which waveguides may be selected to meet the criteria described in detail herein.

In FIG. 1, the microwave energy of the desired frequency range is shown to propagate through the circular waveguide along the direction of the dofted line 135 in a conventional manner. Circular waveguide section 125 is provided to form an aperture for receiving or transmitting electromagnetic energy of a desired frequency range and is selected to have length and diameter sufficient to meet desired radiation properties of gain, beam width, crosspolarization or the like. Symmetrically shaped tapering conical frustrum waveguide section 115 is provided as a means to transition from circular waveguide section 125 to circular waveguide section 110, sustain propagation of electromagnetic energy of the desired frequency range, while providing a low impedance path for higher order modes, which become evanescent within the taper region, and is selected to have a larger diameter sufficient to dispose concentrically with the radiation aperture provided by circular waveguide section 125. The smaller diameter and length of tapered waveguide section 115 are chosen to optimize attenuation of higher-order modes without reaching the waveguide cutoff frequency of the dominant mode of the desired frequency range. Circular waveguide section 110 provides a coupling means to minimize attenuation of the propagated electromagnetic microwave energy of the desired frequency range while providing a transition means for injection or removal of electromagnetic energy from the waveguide, and is selected to have a diameter to dispose concentrically with waveguide section 115 and length to support propagation of electromagnetic waves of the desired frequency range. Circular waveguide termination wall 120 is provided as a means to contain electromagnetic energy within the waveguide, present a low impedance reference plane for electromagnetic energy of the desired frequency range, and is selected to have a diameter sufficient to dispose concentrically with circular wave-guide section 110. The intersecting waveguide elements 125, 115, 110, and 120 may be fabricated in integral unitary relationship from a single piece of metal, casting, or by fusible metals or methods, with material of sufficient conductivity for the frequency of operation and sufficient strength for intended purpose by those persons skilled in the microwave art. For operating ranges between 10.95 GHz to 12.7 GHz, X and Ku band, cylindrically shaped waveguide section 125 is approximately 0.745 lD×1.0 inches, conical frustrum waveguide section 115 is about 0.5 inches in length tapering roughly 3.38° radially from 0.745ID–0.686ID, and cylindrically shaped waveguide section 110 is approximately 0.686ID×1.5 inches.

Referring again to FIG. 1, there is shown in the wall of circular waveguide section 110 signal cable connectors (100 and 100'), highly linear radio frequency (RF) electric (E)-field probes (E-field Probe-1 130 and E-field Probe-2 130') and RF impedance posts (105 and 105'). The signal cable connectors (100 and 100') provide a signal transmission means for the electromagnetic energy that is injected or removed from circular waveguide section 110 from the E-field probes (130 and 130'). However, signal transition means accomplished by the signal cable connectors (100 and 100'), may take a number of forms, such as by direct connection to low noise amplifiers (LNA) transmitter printed circuit boards, which are readily apparent to one of ordinary skill in the art. E-field probes (130 and 130') are used to inject or remove energy from circular waveguide section 110 and are arranged in an orthogonal and nonplanar relationship for signal detection means and for high probe-to-probe isolation when used in conjunction with the RF Impedance posts (105 and 105').

It should now be noted that the orthogonal and nonplanar relationship of the E-field probes (130 and 130') and positioning of RF Impedance posts (105 and 105') within circular waveguide section 110 is a novel aspect of this invention that not only permits the electromagnetic signal extraction, but more importantly results in the polarization diverse characteristics of this high-isolation waveguide feed assembly 140. In order that this aspect of the invention may be properly understood and appreciated, it is essential to first examine the structure that defines the sense of electromagnetic wave polarization.

Figure 3A:
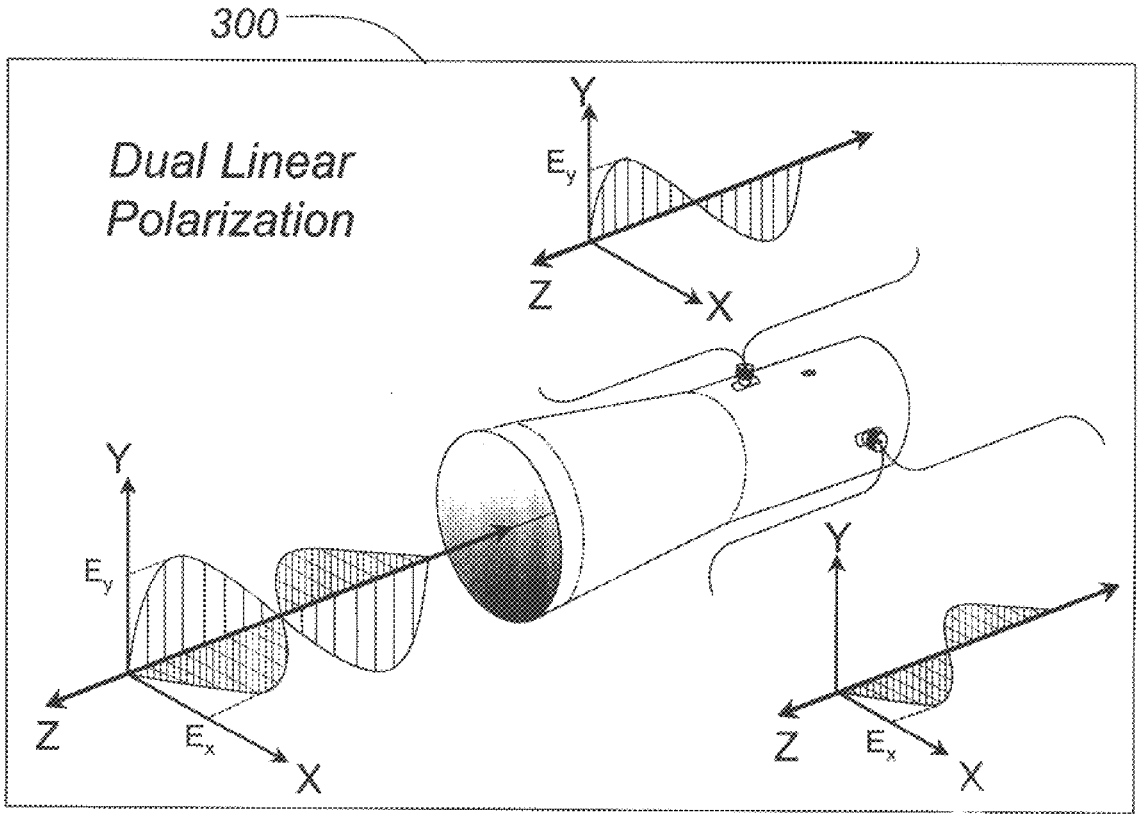
FIG. 3A is an example illustration of dual linear polarization decomposition and electromagnetic signal extraction methodology for an embodiment of the FIG. 1 waveguide feed.
Figure 3B:
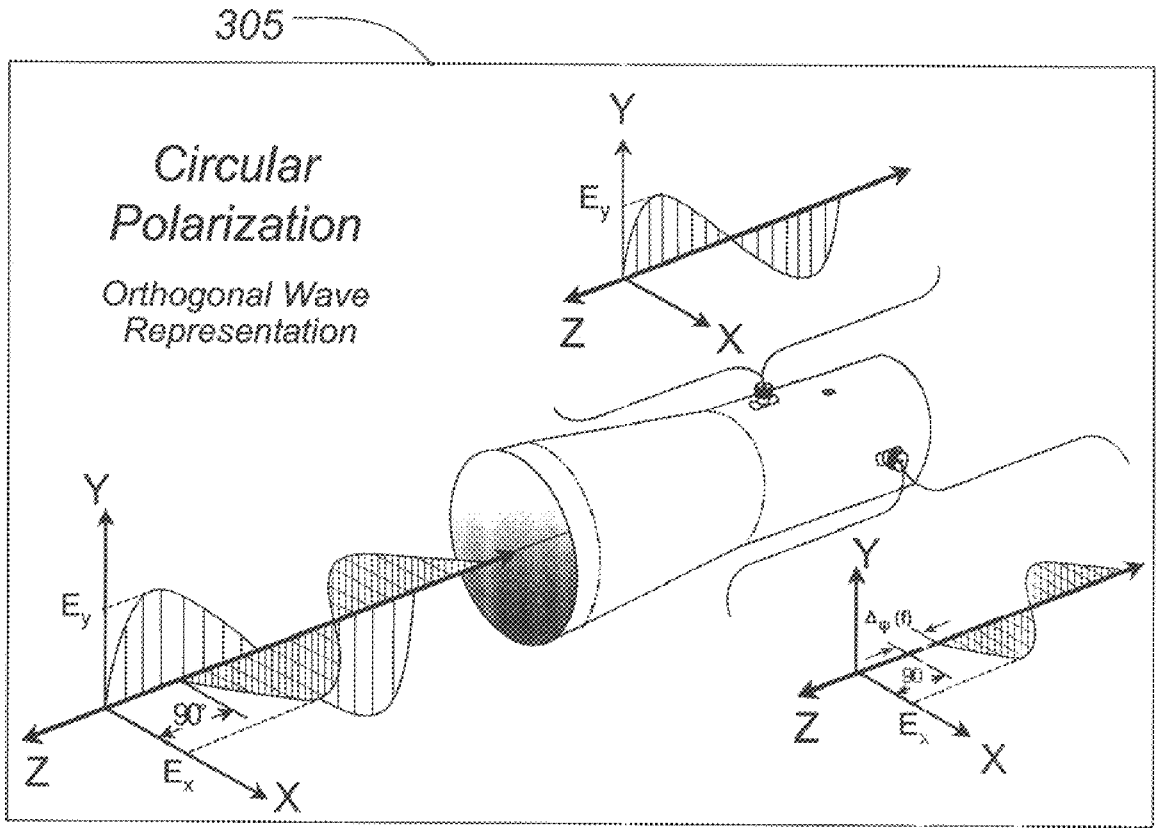
FIG. 3B is a first example illustration of circular polarization wave decomposition and electromagnetic signal extraction methodology for a first embodiment of the FIG. 1 waveguide feed.

There is shown in FIG. 3 diagrams of the means by which electromagnetic signal energy is extracted by the E-field probes (100 and 100') from circular waveguide section 110. It is a well known relationship that an arbitrary electric field, that oscillates on a straight line within a X-Y reference plane perpendicular to the transmission direction, can be resolved into two orthogonal components, $E_x$, electric field strength in the X-direction, and $E_y$, electric field strength in the Y-direction, that are aligned with a reference coordinate system. FIG. 3A depicts an example illustration 300 of how an arbitrary dual linear polarized wave can be described by two linear orthogonal E-field components $E_x$ and $E_y$, which may have amplitude difference, but no phase variation. Additionally, FIG. 3B shows another example illustration 305 of how a perfectly circular polarized wave can be described by two linear orthogonal field components, $E_x$ and $E_y$, which exhibit identical magnitude and a phase difference of 90°. When the phase difference is +90° the electromagnetic wave is right-hand circular polarized (RHCP), while a phase difference of −90° indicates a left-hand circular polarized (LHCP) electromagnetic wave. There is also shown in FIG. 3B example illustration 305 a calibrated waveguide dispersion phase shift $\Delta_\Phi$ (f) that results from the nonplanar arrangement of E-field probes (300 and 300') and whose magnitude is a function of the operating frequency, which is removed in the signal recovery circuitry that interfaces with the waveguide feed assembly.

Referring again to FIG. 1 and to the cutaway and section views of FIG. 2, it is readily seen the orthogonal arrangement of the E-field probes (130 and 130') permits linear decomposition of any elliptically polarized electromagnetic wave into a vertical component, detected by E-field Probe-1 130, and a horizontal component, detected by E-field Probe-2 130', both having amplitude and phase, which together determine the polarization angle of the electromagnetic wave in circular waveguide section 110. The nonplanar arrangement of the E-field probes (130 and 130') allows for positioning RF Impedance posts (105 and 105') in a manner to provide high isolation between the linear decomposed electromagnetic waves detected by the probes. RF impedance posts (105 and 105') are constructed with material of sufficient conductivity for the frequency of operation, positioned in-line with each other and parallel to E-field Probe-1 130, disposed between E-field Probe-1 130 and E-field Probe-2 130', extending through circular waveguide section 110, and electrically and physically joined to circular waveguide section 110 by fusible metals or methods, interference fit, or other machining method. The configuration, size, spacing, and characteristics of the RF impedance posts (105 and 105') are chosen to present a low impedance (short) to vertical polarized signal component energy at E-field Probe-1 130, such that vertical polarized signal component energy does not pass through to E-Field Probe-2 130', and to present high impedance (open) to horizontal polarized signal component energy, which propagates in circular waveguide section 110 to E-field Probe-2 130'.

Referring now to the section and cutaway views of FIG. 2, there is shown insulating sleeves (205 and 205') comprising a suitable dielectric material known in the art surrounding the E-field probes (130 and 130') shafts. The thickness, length, and type of dielectric material chosen for the dielectric encasements (205 and 205') and the center pin length and diameter for the E-field probes (130 and 130') are chosen to provide optimal impedance matching over the useful bandwidth of electromagnetic energy of the desired frequency range. Affixed concentrically to the tip of E-field probes (130 and 130') are electrically and physically coupled isotropic E-field probe enhancements (200 and 200'), which are fabricated from metal of sufficient conductivity for the frequency of operation, and having size and shape chosen to provide a means to increase the bandwidth of the electromagnetic energy propagating in circular waveguide section 110.

For operating ranges between 10.95 GHz to 12.7 GHz, X and Ku band, E-field probes (130 and 130') are approximately 50 mils in diameter and protrude about midway into circular waveguide section 110, RF impedance posts (105 and 105') approximately 50 mils in diameter, located nearly two-thirds the distance from E-field probe 130 to E-field 130', and positioned laterally in circular waveguide section 110 proportionally dividing its diameter into three roughly equal segments, insulating sleeves (205 and 205') constructed of 56 mil thick Teflon material having length that is approximately flush with the interior surface of circular waveguide section 110, and E-field probe enhancements (200 and 200') resembling circular disks with approximate diameter of 90 mils and thickness about 20 mils.

It is understood that, while the detailed drawings, specific examples, and particular values given describe preferred exemplary embodiments of the present invention, they are for the purpose of illustration only. The apparatus and method of the present invention is not limited to the precise details of the conditions disclosed. Accordingly, changes may be made to the details disclosed without departing from the spirit of the invention the scope of which should be determined by the following claims.

We claim:

1. A circular waveguide antenna feed comprising:

a first circular waveguide section having a diameter for supporting electromagnetic waves of desired frequency range from a source there of;

a symmetrically shaped tapering conical frustrum waveguide section of said first circular waveguide diameter and affixed concentrically for providing a low impedance means for higher order mode electromagnetic waves, while coupling said desired frequency range electromagnetic waves to output end;

a second circular waveguide section having a diameter of said symmetrically shaped tapering conical frustrum waveguide smaller diameter and affixed concentrically for the propagation of the desired frequency range electromagnetic waves;

a pair of electric field probes disposed in orthogonal and non-planar arrangement affixed to and protruding into said second circular waveguide section for output of linear orthogonal signal components of the desired frequency range electromagnetic waves; and a pair of radio frequency impedance posts affixed to and extending laterally through the second circular waveguide section disposed substantially parallel between said pair of electric field probes and a circular waveguide termination wall having a diameter of the second circular waveguide section and affixed concentrically to the second circular waveguide section for providing a means to separate said linear orthogonal detected signal components of the desired frequency range electromagnetic waves.

2. The antenna feed in accordance with claim 1, including signal transition means coupled to said pair of electric field probes for the transmission of the linear orthogonal signal components of the desired frequency range electromagnetic waves from the second circular waveguide section.

3. A circular waveguide antenna feed comprising:

a first circular waveguide section having a diameter for supporting electromagnetic waves of desired frequency range from a source there of;

a symmetrically shaped tapering conical frustrum waveguide section of said first circular waveguide diameter and affixed concentrically for providing a low impedance means for higher order mode electromagnetic waves, while coupling said desired frequency range electromagnetic waves to output end;

a second circular waveguide section having a diameter of said symmetrically shaped tapering conical frustrum waveguide smaller diameter and affixed concentrically for the propagation of the desired frequency range electromagnetic waves;

a pair of electric field probes disposed in orthogonal and non-planar arrangement affixed to and protruding into said second circular waveguide section for output of first and second linear orthogonal detected signal components of the desired frequency range electromagnetic waves; and a pair of radio frequency impedance posts affixed to and extending laterally through the second circular waveguide section disposed substantially parallel between said pair of electric field probes for providing a low impedance (short) for said first linear polarized detected signal component, and a circular waveguide termination wall having a diameter of the second circular waveguide section and affixed concentrically to the second circular waveguide section for providing a low impedance (short) for said second linear polarized detected signal component of the desired frequency range.

4. The antenna feed in accordance with claim 3, including signal transition means coupled to the pair of electric field probes for the transmission of the first and second linear polarized detected signal components of the desired frequency range from the second circular waveguide section.

5. The antenna feed of claim 3 wherein said orthogonal and non-planar positioning of the electric field probe pair corresponds to minimizing undesirable cross-polarization components of linear polarized signals while maximizing rejection of unwanted linear cross polarization of the linear orthogonal detected signal components that comprise elliptically polarized electromagnetic waves of the desired frequency range electromagnetic waves detected by each electric field probe.

6. A circular waveguide antenna feed comprising:

a first circular waveguide section having a diameter for supporting electromagnetic waves of desired frequency range from a source there of;

a symmetrically shaped tapering conical frustrum waveguide section of said first circular waveguide diameter and affixed concentrically for providing a low impedance means for higher order mode electromagnetic waves, while coupling said desired frequency range electromagnetic energy to output end;

a second circular waveguide section having a diameter of said symmetrically shaped tapering conical frustrum waveguide smaller diameter and affixed concentrically for the propagation of the desired frequency range electromagnetic waves;

a first electric field probe affixed to and protruding into the forward portion of second circular waveguide section for output of first detected polarized signal component of the desired frequency range;

a first electric field probe low-loss dielectric insulating sleeve affixed to said first electric field probe for impedance matching of said first detected polarized signal component of the desired frequency range;

a first electric field probe enhancement affixed to the first electric field probe tip for increasing bandwidth of the first detected polarized signal component of the desired frequency range;

a first signal transition means coupled to the first electric field probe for transmission of the first detected polarized signal component of the desired frequency range from the second circular waveguide section;

a second electric field probe affixed to and protruding into the rearward portion of the second circular waveguide section orthogonal to the first electric field probe for output of second detected polarized signal component of the desired frequency range;

a second electric field probe low-loss dielectric insulating sleeve affixed to said second electric field probe for impedance matching of said second detected polarized signal component of the desired frequency range;

a second electric field probe enhancement affixed to the second electric field probe tip for increasing bandwidth of the second detected polarized signal component of the desired frequency range;

a second signal transition means coupled to the second electric field probe for transmission of the second detected polarized signal component of the desired frequency range from the second circular waveguide section;

a first radio frequency impedance post affixed to and extending laterally through the second circular waveguide section substantially parallel to the first electric field probe and positioned between the first and second electric field probes for providing a low impedance (short) to the first detected polarized signal component of the desired frequency range while providing a high impedance (open) as to not impede propagation of the second detected polarized signal component of the desired frequency range within the second circular waveguide section;

a second radio frequency impedance post affixed to and protruding laterally through the second circular waveguide section substantially parallel to the first electric field probe and inline laterally with said first radio frequency impedance post for providing a low impedance (short) to the first detected polarized signal component of the desired frequency range while providing a high impedance (open) as to not impede propagation of the second detected polarized signal component of the desired frequency range within the second circular waveguide section; and a circular waveguide termination wall having a diameter of said second circular waveguide section and affixed concentrically for providing a low impedance (short) for the second detected polarized signal component of the desired frequency range within the second waveguide section.

7. The antenna feed of claim 6 wherein the electromagnetic waves are of arbitrary linear, right-hand circular, left-hand circular, or elliptical polarization.

8. The antenna feed of claim 6 wherein the first circular waveguide section is chosen to meet desired radiation properties of gain, beam width, and cross polarization.

9. The antenna feed of claim 6 wherein the first and second electric field probes are center pin extensions of a coaxial connector.

10. The antenna feed of claim 6 wherein the first electric field probe is approximately positioned centrally in the forward trisected region formed from the longitudinal dimension of the second waveguide section.

11. The antenna feed of claim 6 wherein the second electric field probe is approximately positioned centrally in the rearward trisection region formed from the longitudinal dimension of the second waveguide section.

12. The antenna feed of claim 6 wherein the first and second electric field probes protrude approximately midway into the second waveguide section cavity.

13. The antenna feed of claim 6 wherein said low-loss dielectric material is approximately 56 mils in thickness.

14. The antenna feed of claim 6 wherein the first and second electric field insulating sleeve is approximately flush with the interior surface of the second waveguide section cavity.

15. The antenna feed of claim 6 wherein said first and second electric field probe enhancement comprises:

a circular disk approximately corresponding to first and second radio frequency impedance post separation distance and about 20 mils in thickness;

wherein said circular disk is affixed concentrically to the tip of the electric field probe.

16. The antenna feed of claim 6 wherein the plane formed by the longitudinal axes of the radio frequency impedance posts is approximately two-thirds the distant from the first electric field probe to the second electric field probe.

17. The antenna feed of claim 6 wherein the first and second radio frequency impedance posts proportionally divides laterally the waveguide inner dimension.

18. The antenna feed of claim 6 wherein the first and second impedance posts diameter is approximately 50 mils in thickness.

19. The antenna feed of claim 6 wherein the total length and width of the horizontal plane and vertical plane as assembled, approximates three inches by one inch.

20. The antenna feed of claim 6 wherein the desired frequency range is between 10.95–12.7 gigahertz.

* * * * *